United States Patent [19]

Rose et al.

[11] 3,952,222

[45] Apr. 20, 1976

[54] PICKUP TUBE TARGET

[75] Inventors: Albert Rose, Princeton; Appleton D. Cope, Hightstown, both of N.J.

[73] Assignee: RCA Corporation, New York, N.Y.

[22] Filed: Aug. 10, 1955

[21] Appl. No.: 527,619

[52] U.S. Cl. ..... 313/366; 313/386

[51] Int. Cl.[2] ..... H01J 31/00; H01J 31/26

[58] Field of Search ..... 313/65, 94, 366, 368, 313/386, 365, 367, 384, 392; 315/11, 12, 10; 357/31

[56] References Cited

UNITED STATES PATENTS

| | | | |
|---|---|---|---|
| 2,208,455 | 7/1940 | Glasser et al. | 357/61 |
| 2,547,386 | 4/1951 | Gray | 328/123 |
| 2,582,850 | 1/1952 | Rose | 250/211 |
| 2,588,254 | 3/1952 | Lark-Horovitz et al. | 136/89 |
| 2,735,049 | 2/1956 | DeForest | 357/34 |
| 2,749,463 | 6/1956 | Pierce | 313/366 |
| 2,890,359 | 6/1959 | Heijne et al. | 313/366 |

FOREIGN PATENTS OR APPLICATIONS

| | | | |
|---|---|---|---|
| 692,337 | 6/1953 | United Kingdom | 315/12 |

OTHER PUBLICATIONS

P–N Junction Transistors, by Shockley et al., Physical Review, Vol. 83, No. 1, July 1, 1951, pp. 151–162.

Electron Processes in Photoconductors, by Edmund S. Rittner, a paper presented at the Photoconductivity Conference held at Atlantic City, Nov. 4–6, 1954, a copy of the paper may be found on pp. 215–268 of Photoconductivity Conf. published by Wiley & Sons, Inc.

*Primary Examiner*—Maynard R. Wilbur
*Assistant Examiner*—T. M. Blum
*Attorney, Agent, or Firm*—Glenn H. Bruestle; Robert J. Boivin

EXEMPLARY CLAIM

1. A television camera tube comprising an elongated envelope, an electron gun in one end of said envelope for producing an electron beam, a target electrode in the other end of said envelope and in the path of said beam, said target electrode comprising a transparent conductive coating, a N-type photoconductor on said coating, a P-type photoconductor on said N-type photoconductor, another N-type photoconductor on said P-type photoconductor, a rectifying junction formed between each adjacent pair of said photoconductors and means for applying a reverse bias across at least one of said junctions.

9 Claims, 7 Drawing Figures

INVENTORS
APPLETON D. COPE &
ALBERT ROSE
BY William A. Babcock
ATTORNEY

PICKUP TUBE TARGET

This invention relates to television pickup, or camera, tubes. In particular this invention relates to improved target structures for television pickup tubes.

In the past there have been various structures for television pickup tubes and for targets therein. Normally the targets have fallen within the two broad classes of photoemitting surfaces and photoconducting surfaces. Targets including photoconductive surfaces require photoconductive materials having a resistivity in the dark of at least $10^{11}$ ohm centimeters in order to retain stored information for the 1/30th of a second frame time of the standard television scanning rate. Targets having photoconductive materials of low resistivity in the dark become charged in the dark areas as well as those areas where conduction is produced by photo-action. Thus, the discharging effect of the electron beam is undistinguishable in both the light and dark areas of the target, and the output or video signal of the tube has no distinguishable modulation. Because of this resistivity limitation certain photoconductive materials, which are otherwise desirable, are eliminated from use in pickup tubes.

Photoconductive materials are normally quasi-insulators in the dark. In photoconductive materials, when an electron is removed from its bond in its atomic structure, there is established in the material a localized positive, electron deficiency region called a hole. In some materials the hole has a freedom of motion while the electron is quickly trapped and prevented from passing through the material with the same facility as the hole. In these materials the hole may move through the material hapharzardly because of thermal agitation and also in a given direction when an electrostatic field is impressed across the material. The hole being positive can be considered as a positive charge carrier and moves from plus to minus under the urging of the impressed electrostatic field. Materials in which the holes have a greater mobility, or in which there is an excess of holes produced, may be referred to as P-type materials; that is, in P-type materials the majority of the charge carriers are holes. In other materials known as N-type materials, an electron removed from its atom has a greater freedom of motion through the material than the hole formed by its removal, or a greater number of electrons are present than holes. In N-type materials, therefore, the majority of charge carriers are electrons.

A third type of material is an intrinsic material which is one in which the holes and electrons formed in the material provide equal conductivity of charges through the material under the urging of an applied electric field. Materials of all three types are known, that exhibit photoconductive properties, but which have resistivities that are too low for storage tube operation.

As described, when there is no electric field applied to the photoconductor the free electrons, or free holes, move in accordance with thermal agitation and in a completely random motion. An electric field applied across the photoconductor, which is the case during pickup tube operation even in the dark, provides a directional motion superimposed on the random motion. When the resistivity of the photoconductor is too low, the conductivity of free electrons, or of free holes, present in the photoconductive material is high and these free electrons, or free holes, produce a current in the dark that cannot be distinguished from a current produced by light from an object to be reproduced. Also, when the random motion of free holes or electrons is too large, a charge established by light from an object is diffused by this random motion and is therefore not stored until the electron beam re-scans the "charged" area.

It is therefore an object of this invention to provide a new and novel pickup tube.

It is another object of this invention to provide a new and improved target structure for use in a pickup, or camera, tube.

It is a further object of this invention to provide an improved pickup tube target which permits the use of materials having resistivities in the dark that are less than $10^{11}$ ohm centimeters.

These and other objects are accomplished in accordance with this invention by providing an improved target for a television pickup or camera tube. The target comprises a signal plate with a rectifying P-N junction arranged on the beam side of the signal plate. Embodiments of the target include P-N-P and N-P-N junctions. Either the P-type layer or the N-type layer may be scanned by an electron beam, depending upon the type of operation, from a conventional electron gun.

The invention will better be understood by reference to the following specification when read in conjunction with the accompanying single sheet of drawings wherein.

Figure 1:
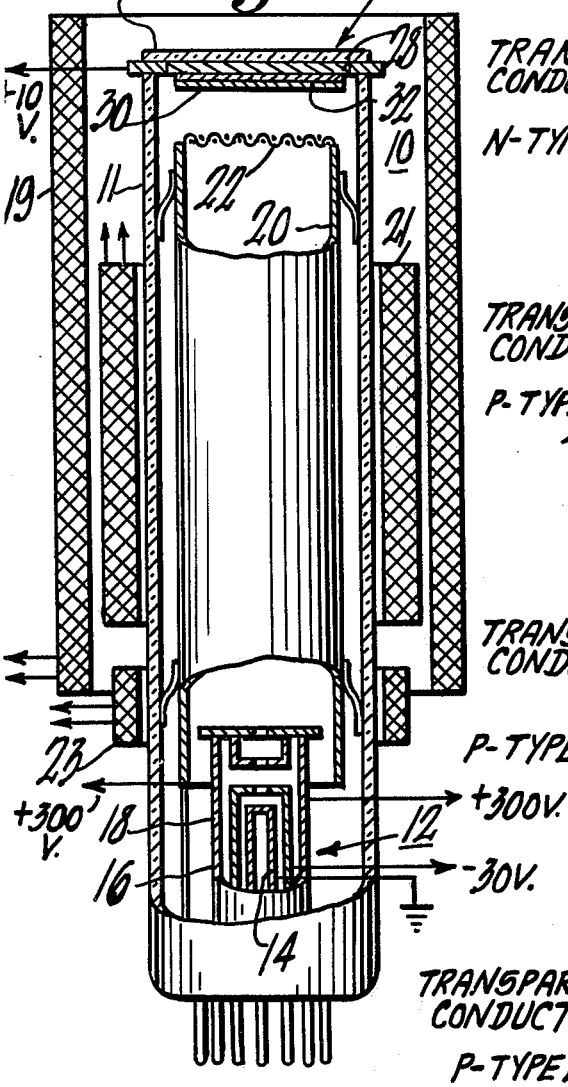
FIG. 1 is a sectional view of a pickup tube in accordance with this invention.
Figure 2:
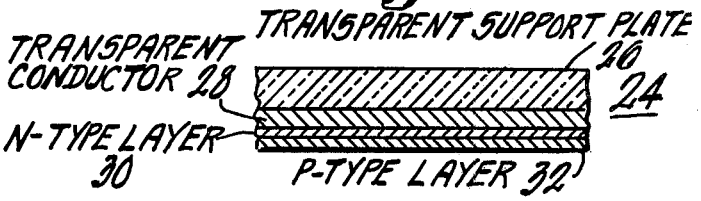
FIG. 2 is an enlarged fragmentary sectional view of the target shown in FIG. 1.

Referring now in detail to FIGS. 1 and 2 there is shown a pickup tube 10 comprising an evacuated envelope 11 having an electron gun 12 in one end thereof. The electron gun 12 comprises a conventional cathode 14, control electrode 16, and one or more accelerating electrodes 18. A final accelerating electrode 20 extends from the gun 12 to the other end of elongated envelope 11, where it is closed by an apertured screen 22. The apertured screen 22 is permeable to the electron beam from gun 12 and acts as an electron collector electrode during certain types of tube operation, and provides a uniform decelerating field in other types of operation. Adjacent to the screen 22 is a target electrode 24 which is shown more clearly in FIG. 2.

Surrounding the envelope 11 is a conventional focusing and deflection system that may include a focus coil 19, a deflection yoke 21 and an alignment coil 23. The focusing coil 19 focuses the electron beam onto the target 24. The deflection yoke 21 deflects the focused beam over the surface of target 24 in a conventional raster pattern.

The target electrode 24 is arranged normal to the electron beam from gun 12. The target 24 comprises a transparent support member 26 which may be the end of envelope 11 as shown in FIG. 1, or may be a separate support element. On the inner surface of the support member 26 is a coating of a transparent electrically conductive film 28, or signal plate, formed of a material such as tin oxide or tin chloride that may be deposited by any of the well known techniques. On the exposed surface of film 28 are deposited two thin layers 30 and 32 of photoconductive material. In accordance with an embodiment of this invention a layer 30 of N-type material is deposited on the conducting member 28, and a layer 32 of P-type material is deposited on the N-type material.

It has been found that, when a P-type material and an N-type material are placed in contact, a rectifying effect is produced when a voltage is impressed across the materials through their regions of contact. Greater resistance to current flow through the two materials occurs when the voltage is impressed across the materials by applying a more negative potential to the exposed surface of the P-type layer 32 than that applied to the exposed surface of the N-type material 30. This application of potential is hereinafter referred to as a reverse bias since it increases the rectifying effect. At the boundary between the P-type material and the N-type material an intrinsic region is formed according to well known principles. This intrinsic region conducts both electrons and holes, but, owing to the barrier field, the electrons are conducted in substantially one direction only when the holes are conducted in substantially only the opposite direction.

During operation, potentials are applied to the tube 10 such as those shown in FIG. 1. The potentials shown are for a type of operation known as low velocity electron beam scanning. In this type of operation, the transparent conducting signal plate 28 is maintained at a potential that is slightly positive with respect to the cathode 14. Electrons from cathode 14 are formed into an electron beam by electrodes 16 and 18 and are accelerated down the tube toward target 24 by the accelerating field of electrode 20. The beam is focused to a small spot on the surface of target layer 32 and is scanned over the target surface in a substantial rectangular raster by the field of deflection yoke 21. The beam is slowed down as it approaches adjacent to target surface of layer 32 by the decelerating fields established between mesh 22 and target 24. Thus, at first, the electrons of the beam land on the exposed surface of photoconductive layer 32 at energies less than enough to provide a secondary electron emission from the surface of layer 32 greater than the current of the beam striking the target. This results in the scanned target surface being driven in a negative direction to establish a reference potential, in the dark, that is substantially equal to the potential of cathode 14. The electrons of the beam are then reflected from areas of the target surface of layer 32 which are at reference potential. Reflected electrons from the target return down the tube toward gun 12 where they are collected by more positive electrodes in the tube.

The target shown in FIGS. 1 and 2 may also be operated with a type of operation that is known as high velocity positive type of operation. In this type of operation the screen 22, which functions as a collector of secondary electrons, is operated at a potential that is slightly negative with respect to the transparent conductive layer 28, which in turn is made highly positive, e.g. several hundred volts, with respect to the cathode 14. When using high velocity positive operation, the electron beam strikes layer 32 with energies of several hundred volts and releases more secondary electrons from the target than primary beam electrons landing on the target. The secondard electrons are redistributed or driven back and onto the target due to the negative, or repelling, potential on the collector screen 22. Due to these potentials the secondary electrons are redistributed on the target until the scanned surface of the target is driven, in a negative direction, to establish a reference potential substantially equal to that of the collector electrode 22 and negative to the potential of signal plate 28.

It should be noted that when the target shown in FIG. 1 is operated in either the low velocity method, or the high velocity positive method, the P-N junction is operating under reverse bias conditions. In other words, for these methods of operation, the P-type layer 32 is biased negatively by the beam and the N-type layer 30 is biased positive by the potential on the transparent electrode 28. This biasing is the reverse direction across the rectifying junction, since the P-type layer 32 normally conducts holes, i.e. the absence of electrons, while the N-type layer 30 conducts electrons.

Figure 6:
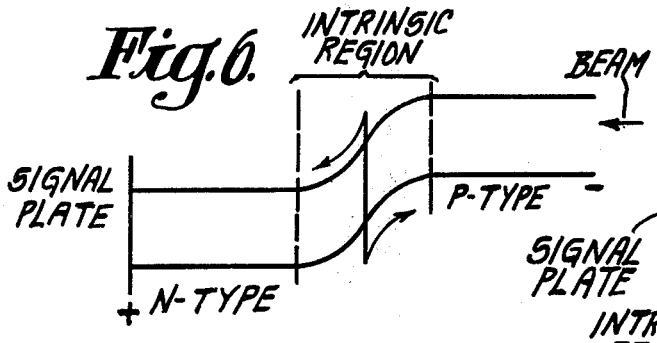

Referring now to FIG. 6 there is shown a schematic representation of the energy levels of a target of the type shown in FIGS. 1 and 2. From this representation it is seen that the intrinsic region between the P and N layers includes a wide strip barrier in the potential distribution. This intrinsic region as described is a region where both electrons and holes are conducted in substantially the same amounts. The barrier in the potential distribution is rather sharp due to the reverse bias that is placed across the P-N junction. Without this reverse bias there is a potential barrier between the P and N layers, due to the nature of the materials. However, with the reverse bias the potential barrier is magnified so that the electrons are pulled more strongly toward the signal plate 28 while holes are pulled more strongly towards the scanned surface of the P-type layer 32.

The reverse bias of the operation of the double layer target because of the rectifying junction, provides a sufficient dark resistivity in the order of $10^{11}$ ohm cm across the target 24, so that the double target layer 30–32 is usable for pickup tube operation even though each material used in double layer may be of lower unusable resistivity.

When it is desired to use a high beam velocity type of operation, the high velocity positive type of operation is preferred for the target shown in FIGS. 1 and 2, this method increases the barrier height of the P-N junction by providing a reverse bias and thus decrease the dark current as was explained above.

Figure 3:
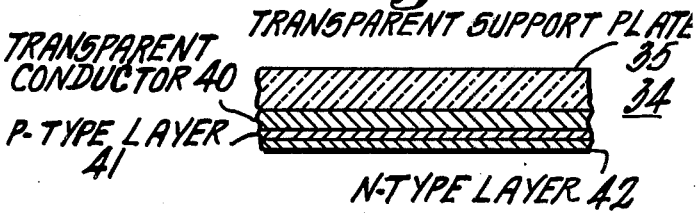
FIGS. 3 through 5 are enlarged fragmentary sectional views of embodiments of target structures in accordance with this invention; and, FIGS. 6 and 7 are schematic representations of the energy states within the targets in accordance with this invention.

Referring now to FIG. 3 there is shown an embodiment of this invention comprising a target 34. Target 34 comprises a transparent support member 35 having a layer of transparent conductive material 40 on one surface thereof. On the transparent conducting layer 40 is a layer of P-type material 41 which in turn is covered by a layer of N-type material 42. At the junction between the P-type material and N-type material an intrinsic region is formed according to well known principles. Interdiffusion of particles at the boundary may aid in the formation of this intrinsic region.

In order to establish reverse bias conditions on the target shown in FIG. 3 it is preferred to operate this target in a method of operation that is known as high velocity negative type of operation. In high velocity negative operation collector electrode 22 is operated at a potential that is slightly positive, in the order of 10 volts, with respect to the transparent conducting electrode 40, which in turn is highly positive in the order of 300 to 400 volts, with respect to the gun cathode 14. When using this type of operation the electron beam releases more secondary electrons from the N-type layer 42 than primary electrons land on this layer. Due to the potentials applied, the secondary electrons are collected by the collector screen 22, until the N-type layer 42 is driven positively to establish a reference potential substantially equal to that of collector electrode 22. This driving in the positive direction of the N-type layer 42 establishes the reverse bias conditions that were explained above. A potential characteristic for the target 34 is substantially the same as that shown in FIG. 6 except that the characteristic is inverted and the N-type layer scanned by the electron beam.

In any of the types of operation referred to above for the structure shown in FIGS. 1–3, a reference or equilibrium potential is established on the scanned surface of the target in the dark as described above. When light from a scene, or object, to be reproduced is directed onto the target, hole-electron pairs are set free in elemental areas in or near the intrinsic region of the P-N junction. Due to the potential difference across the intrinsic region, and to diffusion, these free electrons and holes are conducted in opposite directions before they can recombine with each other. Also, the barrier height is reduced in the elemental areas as the photoconductor becomes conductive under the influence of the light, so that electrons or holes that are set free by the light in both the P-type layer and the N-type layer are conducted. When the holes from any portion of the target layers reach the scanned surface of the P-type layer 32 they establish a charge, with respect to the reference potential, on the surface of layer 32 in the illuminated areas. When the electron beam re-scans these charged areas, it drives the areas back to reference potential and in so doing develops output signals by the capacity coupling between the scanned surface of the P-type layer 32 and the transparent conductor 28. The transparent conductor 28, functions as a signal plate during operation, and is connected to a load circuit not shown in which the output signals of tube 10 are utilized.

In both of the targets shown in FIGS. 2 and 3 there is formed a series resistance to the electron beam in the dark that comprises a low resistance, a high resistance and a low resistance in that order. For example, in FIG. 2 there would be a low resistance comprising the P-type layer 32, a high resistance comprising the intrinsic region, and a low resistance formed by the N-type layer 30. These three resistances of the P-N junction targets in accordance with this invention, are believed to distinguish P-N junction targets from other targets that include two layers of material on a signal plate but which do not form a rectifying junction. In the targets of these prior pickup tubes it is believed that the resistance of these elements was limited solely to that within the particular layers.

As an example of the materials for use in the targets shown in FIGS. 2 and 3, a layer of cadmium selenide may be used for the N-type material with a layer of gray selenium forming a P-type material. In this particular example the cadmium selenide is deposited by any known technique, such as vacuum evaporation, which would form a dark glassy deposit. In the target shown in FIG. 2, heating the support plate 26 to approximately 150° C before the vacuum evaporation is started will improve adherence of the cadmium selenide to the support plate 26. A layer of selenium is then deposited on the cadmium selenide, again by vacuum evaporation. Target 24 is then removed from the vacuum chamber and a glass plate, not shown, is placed over the selenium layer and tightly clamped to the support member 26. This unit is baked at a temperature within the approximate range of 100° to 150°C for a period of time of approximately 30 minutes to convert the amorphous selenium into the gray metallic form of the material. Applying pressure to the surface of the selenium during the conversion to the gray form, accomplishes the two-fold purpose of preventing the selenium from lifting off the surface, and of keeping the selenium distributed uniformly over the cadmium selenide surface. It is believed that either during the deposition of the selenium on the cadmium selenide, or during the conversion of the selenium to the gray metallic form, or both, particles of selenium and particles of cadmium selenide interdiffuse to form the intrinsic region that is represented in FIG. 6. When a target similar to that shown in FIG. 3 is utilized the steps of deposition are reversed so that the P-type layer is deposited first.

When using a P-type layer of gray selenium it is believed that the selenium is in the form of a mosaic, or a plurality of small islands. The reason for this belief is that since gray selenium has a resistivity of $10^5$ ohms centimeters, lateral leakage of the stored charges would cause the loss of resolution if there were a continuous film of this material. Since the targets have good resolution it appears that the gray selenium is in separate islands or in a mosaic form.

when a P-N junction is properly biased in the reverse direction as was explained above, there is only a small dark current since the density of free charges that contraverse the barrier is small. A reservoir of holes exists in the P-type material while a reservoir of electrons exists in the N-type material. When a hole-electron pair is formed in the intrinsic region, or active junction area, due to light falling on the target from an object to be reproduced, the electron of the pair will move through the junction area to the N-type material, while the hole will add a positive charge to the hole reservoir in the P-type material and upset neutrality there. Therefore, an electron can move into the circuit from the N-type material, and from the beam into the P-type material, to neutralize the hole that is present in the P-type materials.

When using a target in accordance with the invention, the resistivity of the N or P type material facing the electron beam must be sufficient to prevent loss of the desired resolution by sideways leakage during a frame time. However, this value of resistivity can be much lower than that needed for frame storage operation of a single layer of photoconductive material used prior to this invention.

Figure 4:
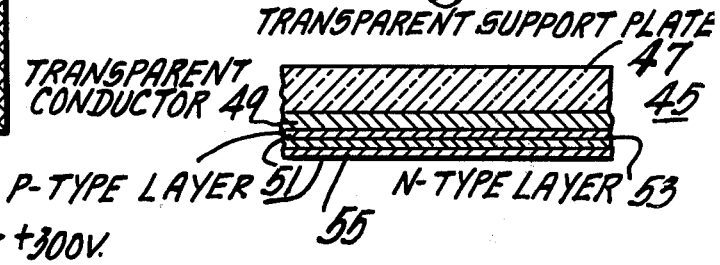

Referring now to FIG. 4 there is shown an embodiment to the invention comprising a target 45 that includes a transparent support member 47. On one surface of the transparent support member 47 having thereon a transparent conductive layer 49. On the transparent conductive layer 49 is a layer of P-type material 51 that has a layer of N-type material 53 thereon. Covering the N-type material 53 is another layer of P-type material 55. Between each pair of layers 51 and 53 and 53 and 55 a different intrinsic region, or rectifying junction, is formed. Thus, this structure produces a phototransistor target. Interdiffusion of particles at the boundaries may aid but is not necessary to the formation of the junctions.

Figure 7:
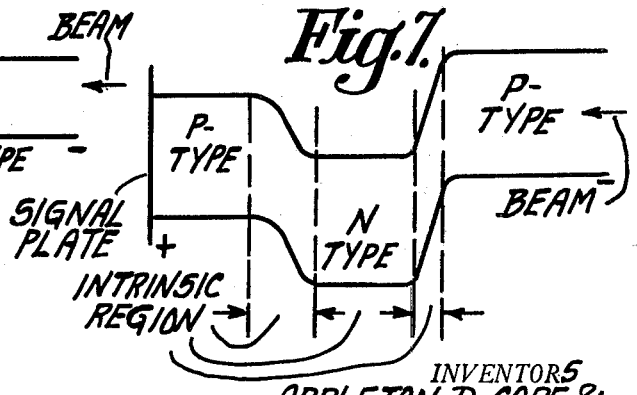

In FIG. 7 there is shown a schematic representation of the energy states within target 45. From this energy state representation it is seen that there are two intrinsic regions within the target where the barrier height divides free electrons and holes for the conduction of these charges in opposite directions. The layer of P-type material that is scanned by the electron beam is at a more negative potential than the layer of P-type material 51 that is on the signal plate 49. As can be seen from this representation of the energy states, the N-type region is a trap for free electrons in that they are not attracted in either direction due to the two rectifying junctions. During operation, when light sets an electron free within this trap, as the electron is active within this trap, i.e. it does not recombine or escape, holes are conducted to the beam side of the P-type layer 55. Thus, target 45 permits a quantum yield greater than unity in that one photon of light may make only one free electron, but several holes may be conducted to the beam side of P-type layer 55 before this one free electron recombines, or is lost from the hole by being conducted to the signal plate 49.

Figure 5:
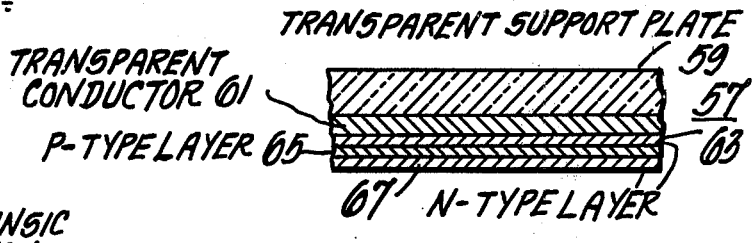

Referring now to FIG. 5 there is shown an embodiment of this invention comprising a target 57 that includes a transparent support member 59. On one surface of the transparent support 59 is a transparent conductive coating 61 which is covered by a layer of N-type material 63. The layer of N-type material 63 is covered by a layer of P-type material 65, which in turn is covered by a layer of N-type material 67. Thus, the target 57 is a phototransistor structure. The energy level diagram for target 57 is substantially the inverse of that shown in FIG. 7 for target 45. Examples of materials that may be used in the target shown in FIG. 4 are:

| P type 51 | N type 53 | P type 55 |
|---|---|---|
| Se | CdS | Se |
| CuO | CdS | CuO |
| $Cu_2O$ | CdS | $Cu_2O$ |

Examples of materials that may be used in the target shown in FIG. 5 are:

| N type 63 | P type 65 | N type 67 |
|---|---|---|
| CdS | Se | CdS |
| CdS | CuO | CdS |
| CdS | $Cu_2O$ | CdS |

Any of the methods of operation described above may be utilized for either of the targets 45 and 57. In other words both of these targets may be used with the low beam velocity method of operation, high beam velocity positive, or high beam velocity negative types of operation.

What is claimed is:

1. A television camera tube comprising an elongated envelope, an electron gun in one end of said envelope for producing an electron beam, a target electrode in the other end of said envelope and in the path of said beam, said target electrode comprising a transparent conductive coating, a N-type photoconductor on said coating, a P-type photoconductor on said N-type photoconductor, another N-type photoconductor on said P-type photoconductor, a rectifying junction formed between each adjacent pair of said photoconductors and means for applying a reverse bias across at least one of said junctions.

2. A television camera tube as in claim 1 wherein both of said N-type photoconductors are formed of a material including cadmium sulphide and said P-type photoconductor is formed of a material including selenium.

3. A television camera tube as in claim 1 wherein both of said N-type photoconductors are formed of a material including cadmium sulphide and said P-type photoconductor is formed of a material including copper oxide.

4. A television camera tube as in claim 1 wherein both of said N-type photoconductors are formed of a material including cadmium sulphide and said P-type photoconductor is formed of a material including cupric oxide.

5. A television camera tube comprising an elongated envelope, an electron gun in one end of said envelope for producing an electron beam, a target electrode in the other end of said envelope and in the path of said electron beam, said target electrode comprising a transparent conductor, said target electrode further comprising photoconductive materials including a phototransistor of P-type, N-type, and P-type materials in the order recited, and means for applying a reverse bias to at least one of the junctions of said phototransistor.

6. A television camera tube comprising an elongated envelope, an electron gun in one end of said envelope for producing an electron beam, a target electrode in the other end of said envelope and in the path of said electron beam, said target electrode comprising a conductor and photoconductive materials including a phototransistor of N-P-N materials in the order recited, and means for applying a reverse bias to at least one of the junctions formed by said phototransistor.

7. A television camera tube comprising an elongated envelope, an electron gun in one end of said envelope for producing an electron beam, a target electrode in the other end of said envelope and in the path of said electron beam, said target electrode comprising a transparent conductive coating, a first P-type photoconductor on said transparent conductive coating, a N-type photoconductor on said first P-type photoconductor, a second P-type photoconductor on said N-type photoconductor and exposed to said electron beam, a first rectifying junction formed between said first P-type photoconductor and said N-type photoconductor, a second rectifying junction formed between said N-type photoconductor and said second P-type photoconductor, and means for forming a reverse bias across at least one of said junctions.

8. A television camera tube as in claim 7 wherein both of said P-type photoconductors are formed of a material including selenium and said N-type photoconductor is formed of a material including cadmium sulphide.

9. A television camera tube comprising an envelope, an electron gun in said envelops for producing an electron beam, a target electrode in said envelope and in the path of said beam, said target electrode including a transparent conductive signal plate, a phototransistor having one surface on said signal plate and the other surface exposed to said beam, said phototransistor including at least two P-N junctions, and means for applying a reverse bias to at least one of said junctions.

* * * * *